US007442049B2

(12) United States Patent
Hougham et al.

(10) Patent No.: US 7,442,049 B2
(45) Date of Patent: Oct. 28, 2008

(54) ELECTRICAL CONNECTING DEVICE AND METHOD OF FORMING SAME

(75) Inventors: Gareth Geoffrey Hougham, Ossining, NY (US); Brian Samuel Beaman, Cary, NC (US); Claudius Feger, Poughkeepsie, NY (US)

(73) Assignee: International Business Machines Corporation, Armonk, NY (US)

( * ) Notice: Subject to any disclaimer, the term of this patent is extended or adjusted under 35 U.S.C. 154(b) by 56 days.

(21) Appl. No.: 11/194,790

(22) Filed: Aug. 1, 2005

(65) Prior Publication Data

US 2007/0004239 A1 Jan. 4, 2007

Related U.S. Application Data

(60) Provisional application No. 60/651,250, filed on Feb. 9, 2005.

(51) Int. Cl.
*H01R 4/58* (2006.01)

(52) U.S. Cl. ..... 439/71; 439/91

(58) Field of Classification Search ..... 439/66, 439/91, 71

See application file for complete search history.

(56) References Cited

U.S. PATENT DOCUMENTS 3,861,135 A * 1/1975 Seeger et al. ..... 368/88
4,064,623 A * 12/1977 Moore ..... 29/876
4,421,370 A * 12/1983 Treakle et al. ..... 439/91
5,123,849 A * 6/1992 Deak et al. ..... 439/66
5,599,193 A * 2/1997 Crotzer ..... 439/66
6,280,207 B1 * 8/2001 Sakata et al. ..... 439/91
6,293,810 B1 9/2001 Goodwin et al. ..... 439/71
6,312,266 B1 * 11/2001 Fan et al. ..... 439/91
6,406,944 B2 * 6/2002 Jiang ..... 438/124
6,705,876 B2 * 3/2004 Eldridge ..... 439/66
6,790,057 B2 * 9/2004 DelPrete et al. ..... 439/91
6,796,810 B2 9/2004 DelPrete et al. ..... 439/86
6,814,584 B2 * 11/2004 Zaderej ..... 439/66
6,853,209 B1 * 2/2005 Jovanovic et al. ..... 324/758
6,921,271 B2 * 7/2005 Liao et al. ..... 439/66
6,923,658 B2 * 8/2005 Cromwell et al. ..... 439/71
7,130,517 B2 * 10/2006 Garito et al. ..... 385/129
7,202,679 B2 * 4/2007 Maruyama et al. ..... 324/754
2003/0186572 A1 * 10/2003 Hougham et al. ..... 439/91
2004/0110400 A1 6/2004 DelPrete et al. ..... 439/86
2004/0110401 A1 6/2004 DelPrete et al. ..... 439/91
2005/0272282 A1 * 12/2005 Setaka et al. ..... 439/86
2006/0057297 A1 * 3/2006 Chevalier et al. ..... 427/387

* cited by examiner

*Primary Examiner*—Neil Abrams
(74) *Attorney, Agent, or Firm*—Daniel P. Morris, Esq.

(57) ABSTRACT

Techniques for providing electrical connections are provided. In one aspect, an electrical connecting device is provided which comprises a plurality of compressible contacts; and a downstop structure surrounding at least a portion of one or more of the contacts, limiting compression of the contacts, and being configured to limit interaction between the contacts. The electrical connecting device may be further configured to have the plurality of compressible contacts have a first coefficient of thermal expansion and the downstop structure have a second coefficient of thermal expansion, the first coefficient of thermal expansion being substantially similar to the second coefficient of thermal expansion.

16 Claims, 9 Drawing Sheets

ELECTRICAL CONNECTING DEVICE AND METHOD OF FORMING SAME

CROSS REFERENCE TO RELATED APPLICATIONS

This application claims the benefit of U.S. Provisional Application No. 60/651,250, filed Feb. 9, 2005.

STATEMENT OF GOVERNMENT RIGHTS

This invention was made with Government support under prime contract NBCH30390004 awarded by the Defense Advanced Research Projects Agency (DARPA). The Government has certain rights in this invention.

FIELD OF THE INVENTION

The present invention relates to techniques for providing electrical connections and, more particularly, to improved electrical connecting devices.

BACKGROUND OF THE INVENTION

In land grid array (LGA) technology, large area rasters or two-dimensional arrays of elastomeric contacts, made of a resilient material, each form an electrical column-shaped interconnection when compressed between an input-output pad on a contact plane surface of a modular structure (e.g., an integrated circuit chip on a carrier or a multi-chip module (MCM)) and a vertically arranged input-output contact location on a surface of a printed circuit board. Each elastomeric contact will provide good electrical conductivity, as long as the column-shaped interconnection remains in compression and in the presence of an opposite direction restoring force that is provided by the compressed elastomeric material. LGA technology has the promise of providing large area, reliable, and steady contacting connections that are spatially close to each other, with those connections, as an array, being readily attached and detached.

As LGA technology is developing, dimensional and pressure control of the array is taking on increasing importance. The fabrication of LGAs is evolving to where the elastomeric contact members are carried on a supporting frame arrangement that provides separation dimension setting members at selected places in the array raster. Compression stop members, known in the art as "downstops," are positioned at selected locations at the edge of the array, so that as the integrated circuit chip module and the printed circuit board are compressed toward each other, the elastomeric contacts deform until the module material reaches the downstop location. This then establishes a selected value two direction gap, of elastomer contact area and a select initial quantity of an opposing pressure to the compression pressure across each elastomeric contact.

In the technology, many of the specifications of the elements involved are interrelated and involve tradeoff considerations. For a dimensional perspective, elastomeric contacts in the range of less than 0.5 millimeter diameter and less than 30 mils in length are being approached.

The state of the art is generally described in J. Xie et al., *An Investigation on the Mechanical Behavior of Elastomer Interconnects*, PROCEEDINGS OF THE 1999 INTERNATIONAL SYMPOSIUM ON MICROELECTRONICS, Pgs. 58-63 (hereinafter "Xie"), the disclosure of which is incorporated by reference herein. Xie points out that there are many structural and environmental factors that can influence elastomeric contact quality and illustrates the handling of arrays of interconnects in a thin plastic sheet. LGAs of elastomeric contacts, sometimes called buttons, or collectively as metal polymer interposers, when mounted in a border frame, are available from manufacturers, such as Tyco Electronics Inc. of Attleborough, Mass.

With arrays of elastomeric contacts, however, there is a chance that, during compression, contacts will expand out laterally and/or in some other way distort and come in contact with each other. This can result in shorting. The potential for unwanted contact to occur is increased as device dimensions decrease, requiring contacts to be placed closer together.

Therefore, contact arrays wherein compression is regulated, e.g., during temperature changes, and wherein unwanted interactions between contacts is minimized or eliminated, would be desirable.

SUMMARY OF THE INVENTION

Techniques for providing electrical connections are provided. In one aspect of the invention, an electrical connecting device is provided which comprises a plurality of compressible contacts; and a downstop structure surrounding at least a portion of one or more of the contacts, limiting compression of the contacts, and being configured to limit interaction between the contacts. The electrical connecting device may be further configured to have the plurality of compressible contacts have a first coefficient of thermal expansion and the downstop structure have a second coefficient of thermal expansion, the first coefficient of thermal expansion being substantially similar to the second coefficient of thermal expansion.

A more complete understanding of the present invention, as well as further features and advantages of the present invention, will be obtained by reference to the following detailed description and drawings.

BRIEF DESCRIPTION OF THE DRAWINGS

FIGS. 1, 2*a*, 2*b*, 2*c* and 3 are cross-sectional depictions of details of elements in an electrical interface, wherein;

FIG. 1 is a cross-sectional depiction, with the compression and restore forces represented by arrows, of a single contact pad portion of the interface of superimposed input output pads connected by an elastomeric interconnect member according to an embodiment of the present invention;

FIG. 2*a* is a cross-sectional depiction of an electrical contact of elastomeric interconnect members before a dimensional pullback of the elastomeric material of the interconnect members according to an embodiment of the present invention;

FIG. 2*b* is a cross-sectional depiction of an electrical contact of elastomeric interconnect members after a dimensional pullback of the elastomeric material of the interconnect members, wherein coefficients of thermal expansion (CTE) are not matched;

FIG. 2*c* is a cross-sectional depiction of an electrical contact of elastomeric interconnect members after a dimensional pullback of the elastomeric material of the interconnect members, wherein CTE are matched according to an embodiment of the present invention;

FIG. 3 is a cross-sectional depiction of a modular structure having single or multiple integrated circuit members interconnected on an intermediate member of ceramic-type or organic-type material in turn connected to a printed wiring type board through elastomeric interconnect members according to an embodiment of the present invention;

FIGS. 5-7 are partially assembled cross-sectional depictions of an exemplary two side by side elastomeric interconnect members positioned between separation setting frame members bordering superimposed contact pad pairs in illustration of the interrelated tradeoff considerations, in which:

FIG. 5 is a cross-sectional depiction of a partially assembled cross-sectional depiction of the exemplary two side by side elastomeric interposer members positioned between separation setting frame members bordering an exemplary area of superimposed contact pad pairs illustrating the positioning of a region of CTE between each downstop member and the substrate wiring board member;

FIG. 6 is a cross-sectional depiction of a partially assembled depiction of the exemplary two side by side elastomeric interconnect members positioned between separation setting frame members bordering an exemplary area of superimposed contact pad pairs illustrating the positioning of a region of different CTE between each separation setting frame member and the substrate wiring board; and between the downstop member and the semiconductor chip;

FIG. 7 is a cross-sectional depiction of a partially assembled depiction of the exemplary two side by side elastomeric interconnect members positioned between separation setting frame members bordering an exemplary area of superimposed contact pad pairs illustrating the positioning of a first region of different CTE between each downstop and the substrate wiring board member; and a second region of different CTE between each downstop member and the semiconductor chip;

DETAILED DESCRIPTION OF PREFERRED EMBODIMENTS

Figure 1:
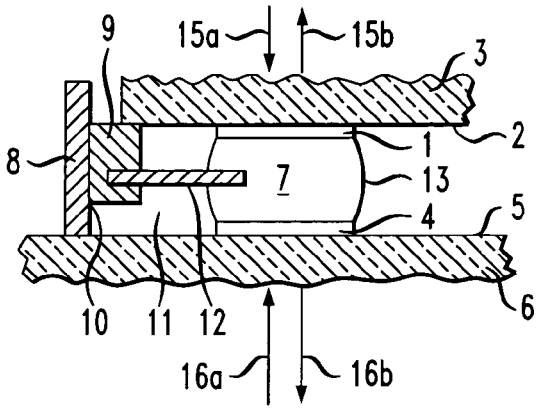

According to the present teachings, arrays, e.g., land grid arrays (LGAs), comprising a plurality of elastomeric interconnects are arranged in a frame that spatially holds the elastomeric interconnects. The frame is typically used with post-type chip module-to-printed wiring board separation members with physical downstop members that limit the chip module to printed wiring board travel. The physical downstop members are built into the frame and positioned so that the movement of superimposed input-output pads on the chip module and on the printed wiring board toward each other is established at a selected proximity at which both the designed permanent compression force on the array and the opposing restoring force from the compressed elastomeric interconnects are in operation. Array configurations comprising elastomeric interconnects are described, for example, in U.S. Patent Application No. 20030186572, filed Apr. 1, 2002 and entitled "Self Compensating Design for Elastomer Interconnects," the disclosure of which is incorporated by reference herein.

In accordance with the present teachings, some failures in these types of arrays are influenced by relaxation of the restoring force under conditions where a physical dimension change in the elastomeric interconnect is detrimental. For example, if the chip module and the printed wiring board are each pressed against a downstop member, which establishes a distance between them, and the force of the contact relaxes, then the electrical connection can become compromised (e.g., there is not enough force pushing against the input-output pads). Specifically, the elastomeric interconnect undergoes a dimensional pullback or shrinkage over time and/or under temperature change which can affect the magnitude of the restoring force. The restoring force in the elastomeric interconnect material begins to decay with time and/or with temperature change, and if permitted to continue, can reach values as low as ten grams to 20 grams per elastomeric interconnect member, with the value moving continuously toward zero at an exponentially decreasing rate.

The elastomeric interconnect members are particularly vulnerable under the low restoring force conditions. A low restoring force condition occurs when the elastomeric interconnect members are configured to be soft, so that a low applied force is all that is needed to deform them to accommodate non-uniformities of the printed wiring board and/or chip module. A low applied force comprises, for example, about 30 grams per interconnect member (grams/interconnect member), e.g., as compared to a typical applied force of about 80 grams/interconnect member. For example, failure may occur where there is a temperature drop of a magnitude that can be as minimal as that produced by turning off the apparatus in which the array is situated.

The shrinkage can result in a reduction in stress on the interconnect member that can change from being in compression to being in tension. These interconnect members typically need greater than about 15 grams/interconnect member of applied force to maintain proper electrical conductivity. Once the interconnect member is in tension, contact between the, e.g., gold, contacting layers on the superimposed input-output pads, would only be maintained by any intrinsic adhesion that may be present.

Under such conditions, the interface, through the elastomeric interconnect members becomes highly unstable and prone to failure. For example, if the adhesion fails, a full open circuit can occur.

Even under conditions where the restoring force decays to low values but the elastomeric interconnect member is still in compression, electrical failures have been observed. There are many types of stresses and strains from different directions that can influence the reliability and durability of the electrical properties of the array through the elastomeric interconnect members, and therefore a certain minimal compressive force across the elastomeric interconnect member is needed for reliable operation.

In accordance with the present teachings, control of the effect of a dimension change in the elastomeric interconnect columns is imparted through including the coefficient of thermal expansion (CTE) property as a design consideration in construction of LGA interposers (including the collective entity of the frame and elastomeric interconnects). For example, the introduction of regions with high CTE, e.g., greater than 100 parts per million (ppm), in the frame introduces a self compensation capability that will be operable to counter the effect of changes in temperature that could otherwise induce a reduction in force or changes from compression to tension in individual interconnect columns. This moderates the net effect of the various stresses in such arrays.

Referring to FIG. 1, there is shown a cross-sectional depiction of a single elastomeric interconnect member of the interface of superimposed input-output pads, with the compression and restore forces represented by arrows.

In the interface of FIG. 1 there is a first, mating, input-output pad 1, on the contact face 2 of a solid state semiconductor device, such as a multi-chip module (illustrated as a single semiconductor chip 3), which is in an aligned, superimposed position with respect to a second mating input-output pad 4 on the conductor face 5 of an external circuitry substrate, such as a printed wiring board 6. In the interface there is the elastomeric interconnect member 7, positioned between the input-output pads 1 and 4.

A frame post member 8 is provided that is positioned to support a downstop member 9 that is attached to the frame post member 8 at surface 10. An overall frame 11, will be made up of frame post members 8 supporting downstop members 9 and interconnect member retention members 12 that holds the elastomeric interconnect members 7 in relative position. The downstop members 9 operate to establish the relative position of a chip surface, e.g., contact face 2, and a printed wiring surface, e.g., conductor face 5, that in turn provides the amount of compression distortion 13, shown as a curved line of the elastomeric interconnect member 7.

In operation there will be a selected compression force, illustrated by the opposing force arrow segments 15*a* and 15*b*, that operates to bring the chip surface, e.g., contact face 2, and the substrate surface toward each other. The selected compression force is opposed by an approximately equal and varying restoration force, illustrated by the opposing force arrow segments 16*a* and 16*b*, produced by the compressed elastomeric material of elastomeric interconnect member 7 (an interconnect column).

In accordance with the present teachings, the restoration force may exhibit decay and shrink over time and with normal environmental cycling temperature change. The effect on the interface is depicted in FIGS. 2*a*-2*c*.

Figure 2A:
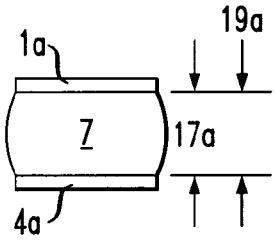

In FIG. 2*a*, under design and initial conditions, the elastomeric material in the elastomeric interconnect member 7, at a dimension 19*a* between pads 1*a* and 4*a* (having a dimension 17*a*, which prior to a dimensional pullback of the elastomeric material is the same as dimension 19*a*) exhibits a slight curvature under the opposing forces, e.g., 15*a* and 16*a* (of FIG. 1), and satisfactory electrical contact between pads 1*a* and 4*a* is provided.

Figure 2B:
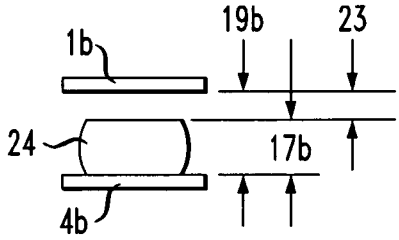

The situation, in the event of a temperature decrease, with an uncompensated frame, e.g., without including the CTE property as a design consideration, is depicted in connection with FIG. 2*b*. The effect of the temperature decrease is that there is a shrinkage of the elastomeric material in the elastomeric interconnect member 24, e.g., to dimension 17*b*, producing a gap 23 with a potential electrical discontinuity between elastomeric interconnect member 24 and the pad 1*b*, while the dimension 19*b* remains essentially the same as dimension 19*a*. The dimensions shown in FIG. 2*b* may occur, for example, when a downstop, such as downstop member 9 of FIG. 1, has a CTE that is less than a CTE of the elastomeric interconnect member.

Figure 2C:
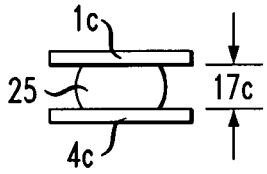

In accordance with the present teachings, in FIG. 2*c* the frame has built into it a favorable CTE that operates to provide some compensation for the shrinkage, permitting each pad 1*c* and 4*c* to move, retaining electrical contact with the reduced elastomeric material in the elastomeric interconnect member 25 to permit the reduction to dimension 17*c* in compensation for the shrinkage, and in doing so maintaining good conductivity even during temperature excursions. For example, dimension 23 of FIG. 2B has been reduced to zero. The dimensions shown in FIG. 2*c* may occur, for example, when a downstop, such as downstop member 9 of FIG. 1, comprises a material that has a CTE that is substantially similar to a CTE of the material of the elastomeric interconnect member. Substantially similar CTEs, in accordance with the present teachings, are described in detail below.

In one exemplary embodiment, the introduction of the CTE as a design consideration is achieved by introducing regions of selected CTE into the frame.

The preferred elastomeric material to be used for the elastomeric interconnect member 7 is a metal particle impregnated or filled siloxane material which, while the siloxane material itself has a high CT-E property, any downside aspects are still tolerable as an elastomeric component. Suitable metal particles include, but are not limited to, conductive silver particles.

There are, in connection with the frame, a number of relatively high CTE materials that can have their physical hardness properties modified by filling. Examples of such materials include, but are not limited to, polymers of polyethylene, polypropylene, polyurethane, epoxies, rubber polymers, such as siloxane or polyphosphazine and combinations comprising at least one of the foregoing materials.

Variation of the amount of metal particle impregnating or filling of an elastomeric siloxane polymer can alter CTE, but the electrical property requirements of the filling particles must be taken into consideration as they may limit flexibility.

Changes in the differential CTE between the elastomeric interconnect member and the overall frame can be imparted by making the parts, such as elastomeric interconnect member 7, post frame member 8 and downstop member 9, e.g., of FIG. 1, with higher or lower CTE, or through the introduction of pads of different CTE material into those parts. As a further illustration, if downstop member 9 were made of, or had, a layer of high CTE material, then the susceptibility of elastomeric interconnect member 7 to shrinkage on cooling would be minimized by the properties of downstop member 9 which would operate to close any gap formation between input-output pads 1 and 4 while keeping the restoring force relatively constant. An ideal situation would be to have the CTE of downstop member 9 be higher and the hardness be greater than that of elastomeric interconnect member 7, because, as shown, for example, in FIG. 1, downstop member 9 has a smaller dimension than elastomeric interconnect member 7. Therefore, upon a change in temperature, the gap between the input-output pads would change by substantially the same amount as the elastomeric interconnect member. See, for example, elastomeric interconnect member 7 and dimension 17*a* in FIG. 2*a*.

In many constructions, advantages are gained by having an intermediate interconnecting interface between the contacts on an integrated circuit chip and the members of the elastomer interconnect assembly. A modular structure is thus produced that also provides fan out capability.

Figure 3:
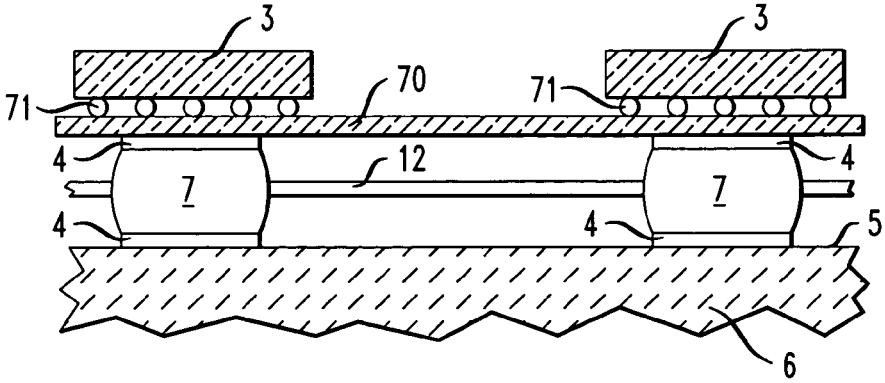

The term "module" generally refers to both the integrated circuit chip interconnection and the modular structure. The modular structure is illustrated in connection with FIG. 3, wherein like reference numerals are used where appropriate. In FIG. 3 there is a cross-sectional depiction of two integrated chips 3 each connected to circuitry (out of view in this illustration) on an intermediate support member 70 through, for example, typical ball contacts 71. Intermediate support member 70 comprises, for example, a ceramic material or an organic material, such as the organic materials available from the Kyocera SLC Technologies Corporation of Shiga Yasu, Japan. Intermediate support member 70 provides fan in circuitry, out of view, joining the ball contacts 71 to the pads 4 on a supporting assembly of elastomeric interconnect members 7 on a surface 5 of a substrate 6. A retaining capability of the interconnect member retention member 12 type is provided with a structural element such as a resilient Kapton™ sheet.

Figure 4:
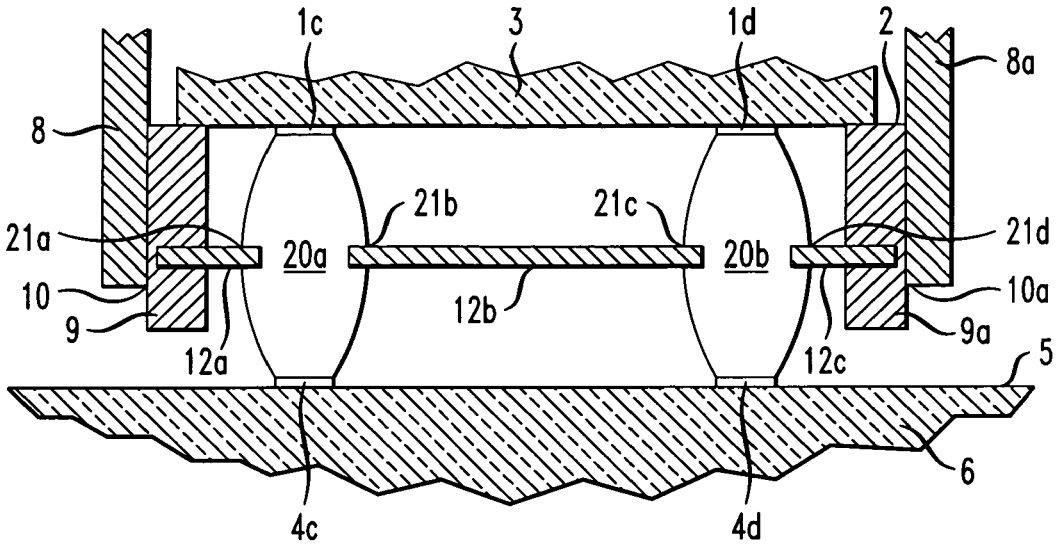
FIG. 4 is a cross-sectional depiction of a partially assembled cross-sectional view of an exemplary two, side by side, elastomeric interconnect members positioned between separation setting frame members bordering an exemplary area of superimposed contact pad pairs in illustration of the retention of the elastomeric interconnect members in the side by side relationship.

In FIG. 4, where like reference numerals with those of FIG. 1 are used where appropriate, there is shown a cross-sectional depiction of a partially assembled exemplary two, side by side, elastomeric interconnect member assembly positioned between separation setting frame members bordering an exemplary area of superimposed contact pad pairs in illustration of the retention of the elastomeric interconnect members in the side by side relationship using framing members supported by insertion into openings in the frame members and in the interconnect members or by the use of the technique of co-molding with the outer frame. The technique of co-molding is also employed in downstop placement.

In FIG. 4 there are two sets of superimposed input-output pads 1*c*/4*c* and 1*d*/4*d*, between the surface 2 on the integrated circuit chip 3 and the surface 5 of the printed wiring element 6. There are two elastomeric interconnect members 20*a* and 20*b*, each a counterpart of elastomeric interconnect member 7, e.g., of FIG. 1.

In elastomeric interconnect members 20*a* and 20*b* there are openings 21*a*, 21*b*, 21*c* and 21*d* to accommodate additional elastomeric interconnect member retaining members such as is illustrated by interconnect member retaining members 12*a*, 12*b* and 12*c*. The interconnect member retaining members look like rods in cross section but are sheet materials or thin plastic. The retaining member 12*a* has one end positioned in an opening in the downstop member 9 and extends into the opening 21*a* in the elastomeric interconnect member 20*a*. The retaining member 12*b* has one end positioned in the opening 21*b* in the elastomeric interconnect member 20*a* and the remaining end positioned in the opening 21*c* in the elastomeric interconnect member 20*b*. The retaining member 12*c* has one end positioned in the opening in downstop member 9*a* and extends into the opening 21*d* in the elastomeric interconnect member 20*b*.

In FIGS. 5-8 variations of ways of compensating for stress through including the CTE in the design of the frame structure are depicted. Specifically, FIGS. 5-8 are partially assembled cross-sectional depictions of exemplary two side by side elastomeric interconnect members positioned between post frame members 8 and 8*a* bordering superimposed contact pad pairs, in illustration of the interrelated tradeoff considerations in the practice of the present teachings.

One tradeoff is based on the fact that the expansion or contraction performance of the member (e.g., frame, downstop member or elastomeric interconnect assembly) of the structure involved can be affected by building into the member a region or a coating of selected CTE, the goal being to have a selected thermal response of the member.

Figure 5:
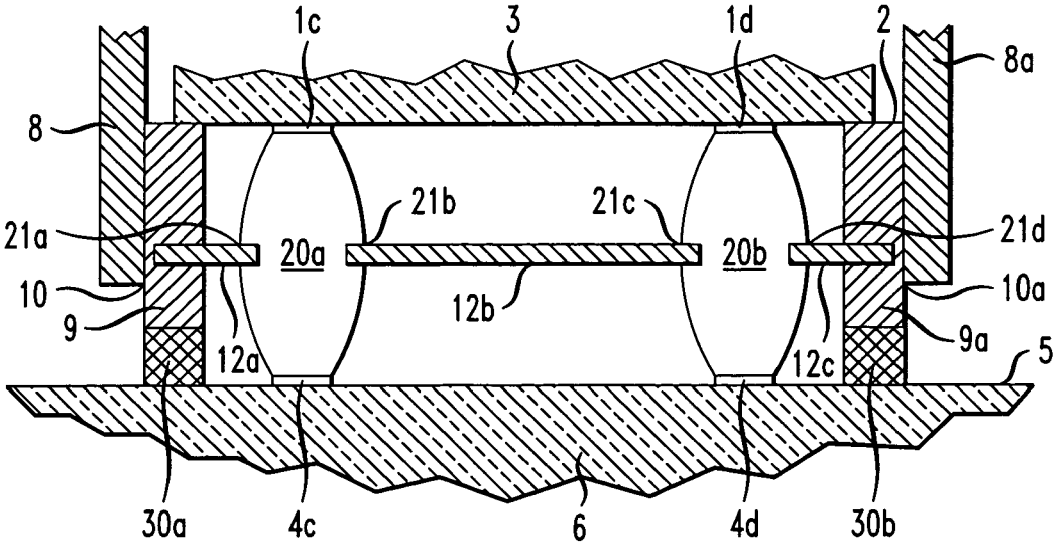
Figure 6:
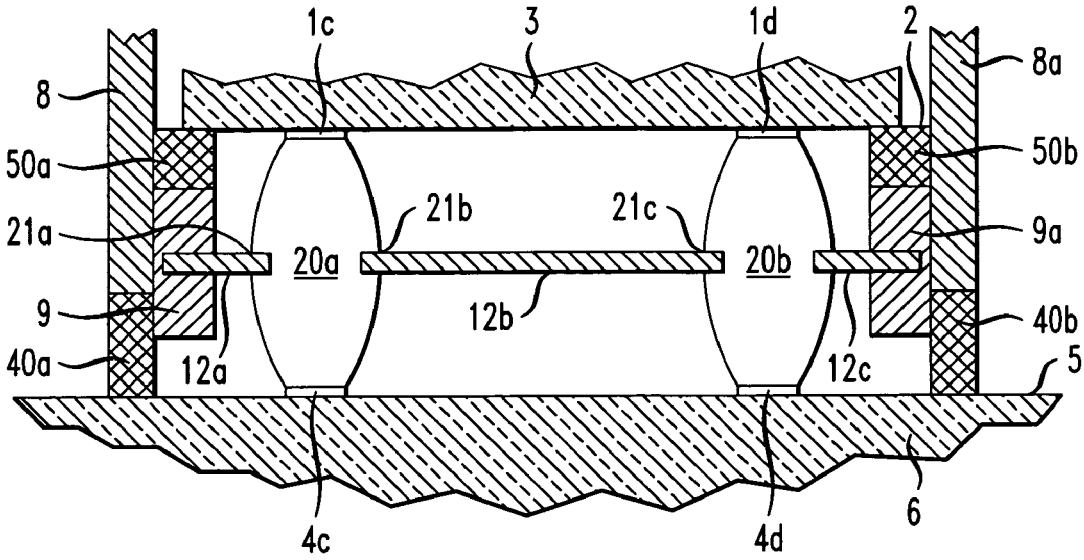
Figure 7:
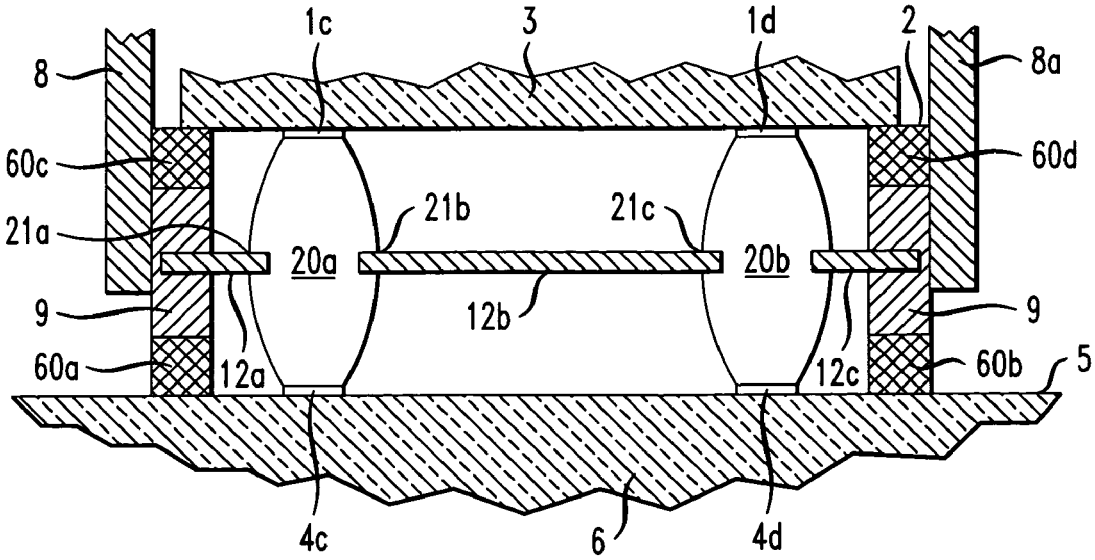

Referring to FIGS. 5, 6 and 7, in each there is shown a cross-sectional depiction of partially assembled exemplary two side by side elastomeric interconnect members positioned in an exemplary frame environment, e.g., of the type shown in FIG. 4.

In FIG. 5, a separate CTE region imparting the design performance, is inserted as an independent element into the frame. This is illustrated as elements 30*a* and 30*b* which extend the downstops 9 and 9*a* to the substrate surface 5.

In FIG. 6, separate CTE regions imparting the design performance are inserted as independent elements at different locations into the frame. In FIG. 6 this is illustrated as elements 40*a* and 40*b* which extend the post frame members 8 and 8*a* to the substrate surface 5 and as elements 50*a* and 50*b* positioned between the downstop members 9 and 9*a* to the surface 2 of the chip 3.

In FIG. 7, multiple separate regions imparting, through selected CTE properties, the design performance, are inserted into a single element of the frame. In FIG. 7 this is illustrated as elements 60*a* and 60*b* which extend the downstop members 9 and 9*a*, respectively, to the substrate surface 5 and as elements 60*c* and 60*d* which extend the same elements, e.g., the downstop members 9 and 9*a*, respectively, to the surface 2 of the chip 3.

In compensating for the elastomeric shrinkage, e.g., shown in FIG. 2*b*, from dimension 17*a* (of FIG. 2*a*) to dimension 17*c* (of FIG. 2*c*), in service, upon a change in temperature, the dimensional increment or decrement contributed by the CTE property of the region of the frame element involved, should be equal (or as close to equal as is practical) to the change in element dimension 17*c* (of FIG. 2*c*) due to it's CTE.

Considering as an illustration the situation in FIG. 6, where separate CTE regions imparting the design performance are inserted as independent elements at different locations into the frame, in this situation, elements 40*a* and 40*b* which extend the post frame members 8 and 8*a* to the substrate surface 5 and elements 50*a* and 50*b* positioned between the downstop members 9 and 9*a* to the surface 2 of the chip 3. In this situation post frame members 8 and 8*a* and the downstop members 9 and 9*a* are of normal CTE, e.g., injection molded plastic. The function of the added regions, e.g., 40*a* and 40*b* and 50*a* and 50*b*, of high CTE material is to control the gap between pad pairs 1*c*/4*c*, and 1*d*/4*d*.

In FIG. 6, the combined thickness, in the dimension between the substrate surface 5 and the surface 2 of the chip 3, times the CTE of the materials, of elements 40*a* and 50*a* in the frame post member 8/downstop member 9 combination and elements 40*b* and 50*b* in the frame post member 8*a*/downstop member 9*a* combination, is arranged to be equal to the column CTE×column height.

Under these conditions, where the high CTE materials of elements 40*a* and 50*a* in the high CTE frame material element is labeled "hcfm," HEIGHT is the distance between substrate surface 5 and chip surface 2 and the height of the elastomeric interconnect members 20*a* and 20*b* then performance follows the expression of Equation 1 as follows:

(CTE) hcfm×(HEIGHT) hcfm>(CTE) interconnect column×(HEIGHT) interconnect column Equation 1

Equation 1, above, is true, for example, because the regular parts of the frame, e.g., downstop members 9 and 9*a*, typically have a low CTE. Therefore, to get a total combined CTE of the downstop stack (e.g., of elements 60*a*, 60*c* and downstop member 9) to equal the CTE of elastomeric interconnect member 20*a*, the CTE of elements 60*a* and 60*c* should be higher than the CTE of elastomeric interconnect member 20*a*. Specifically, the CTE of the downstop stack, e.g., elements 60*a*, 60*c* and downstop member 9, should substantially equal the CTE of the elastomeric interconnect member, e.g., elastomeric interconnect member 20*a*.

As further examples of tradeoffs, if the entire frame itself were made of high CTE material rather than just, e.g., elements 30*a* and 30*b* of FIG. 5, elements 40*a*, 40*b*, 50*a* and 50*b* of FIG. 6 and elements 60*a*, 60*b*, 60*c* and 60*d* of FIG. 7, the structure would be effective but at the present state of the art materials with good frame properties such as injection moldability and strength, while having high CTE, have not been significantly investigated and reported. It is thus advantageous to construct the frame of high CTE regions separate of the frame functions.

It will be further apparent that if the ideal condition stated in Equation 1, above, cannot be achieved, e.g., because of unavailability of materials or because of fabrication limitations, there is still an advantage if progress towards that ideal condition can be achieved. Expressed in another way, if the difference in dimensional changes between the gap dimension 19*b* of FIG. 2*b* and the contact dimension, e.g., dimension 17*b*, of the elastomeric interconnect member can be reduced relative to what it would be without the compensating frame elements, e.g., elements 30*a* and 30*b* of FIG. 5, elements 40*a*, 40*b*, 50*a* and 50*b* of FIG. 6 and elements 60*a*, 60*b*, 60*c* and 60*d* of FIG. 7, it would still be highly desirable.

What has been described is the moderating of the various effects of temperature in high density resilient interconnect structures of the LGA type by building into the arrangement a selected thermal expansion property that operates to exert some control on the thermal dimensional aspects of the elastomeric interconnect in fabrication and throughout service.

Figure 8:
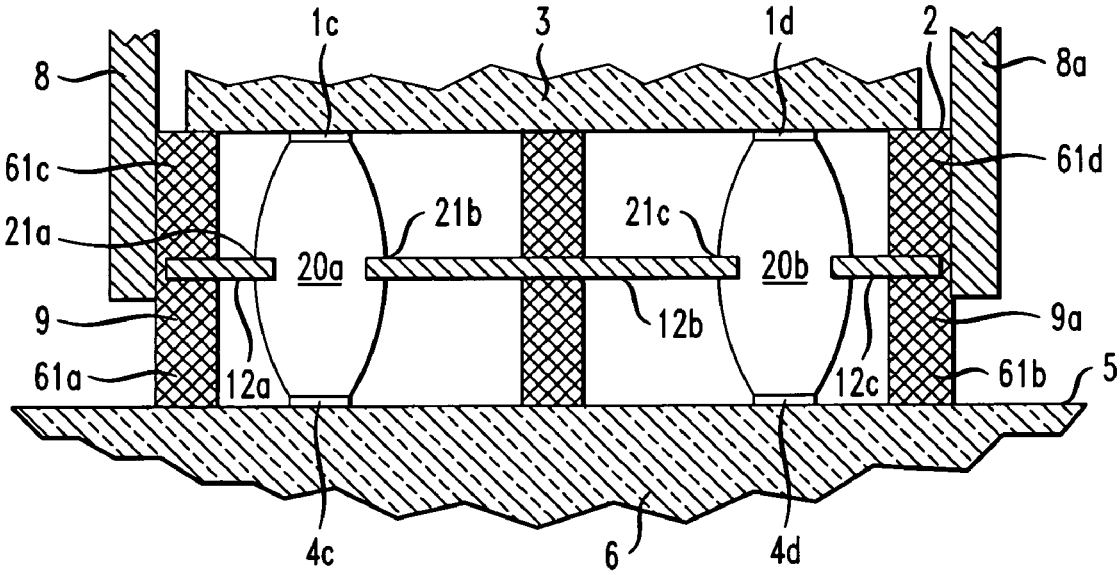
FIG. 8 is a diagram illustrating a cross-sectional depiction of an exemplary contact array and downstop configuration according to an embodiment of the present invention.

FIG. 8 is a diagram illustrating a cross-sectional depiction of an exemplary downstop configuration wherein the downstop member comprises a CTE matching material. In the exemplary downstop configuration shown illustrated in FIG. 8, downstop members, such as downstop members 9 and 9*a* of FIG. 7, are eliminated and elements 61*a-d* constitute the total downstop height. This exemplary configuration is further depicted in the FIGS. 9-13, described below, after compression has proceeded to the point that the downstops are reached.

Figure 9A:
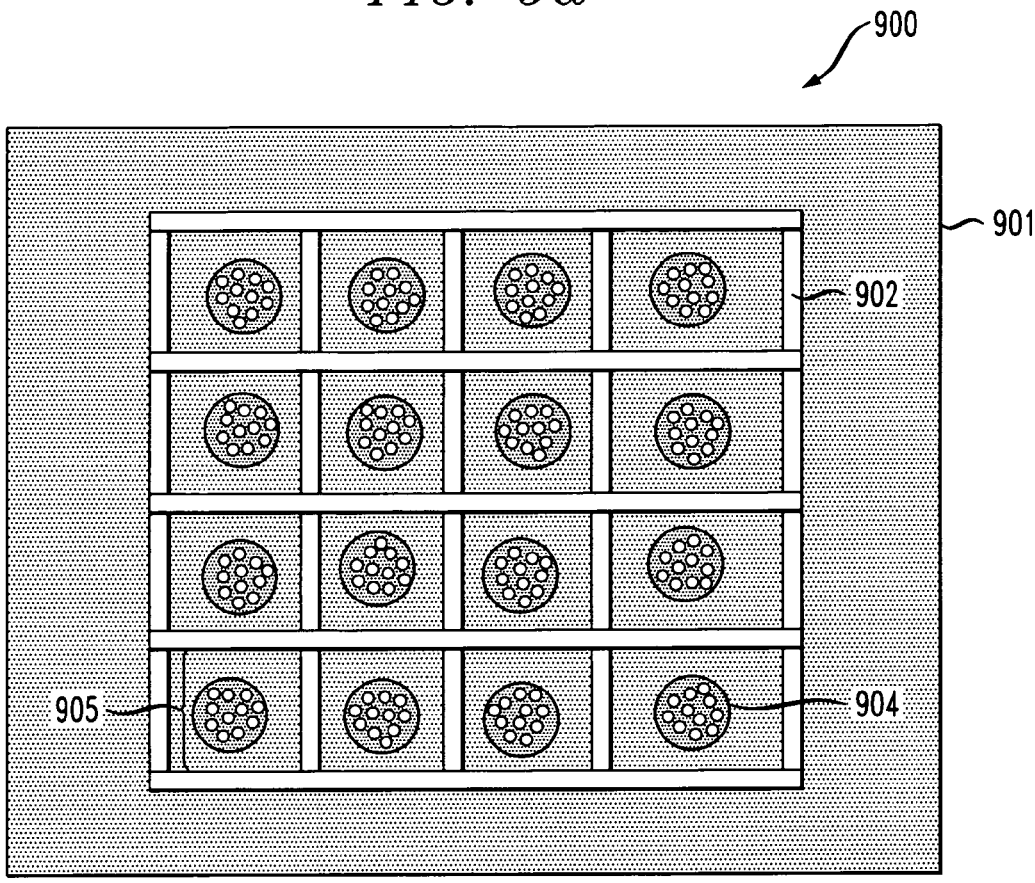
FIG. 9*a* is a diagram illustrating a top-down view of an exemplary contact array according to an embodiment of the present invention.

FIG. 9*a* is a diagram illustrating a top-down view of exemplary contact array 900. Exemplary contact array 900 comprises downstop structure 902 and contacts 904 supported by retaining member 901. As used herein, the term "downstop" refers to any structure that regulates compression, e.g., a compression stop structure. For example, exemplary contact array 900 may be used to connect an integrated circuit chip and printed circuit board and thus would be positioned therebetween. When the integrated circuit chip and the printed circuit board are compressed towards each other, contacts 904 compress/deform until each of the integrated circuit chip and the printed circuit board physically contact downstop structure 902.

According to an exemplary embodiment, contacts 904 comprise a metal/elastomeric material composite, e.g., a metal particle filled polymer, such as the metal particle filled siloxane material described above. Retaining member 901 is similar to retaining member 12, described, for example, in conjunction with the description of FIG. 1, above, in that it holds contacts 904, which pass therethrough, in position.

As shown in FIG. 9*a*, downstop structure 902 is formed into a grid wall structure, or structures, portions of which run in between each of contacts 904, e.g., a continuous grid configuration. The continuous grid configuration comprises a number of compartments formed by the grid, e.g., compartment 905.

As presented above, downstop structure 902 may comprise a selected CTE material. Downstop structure 902, in addition to acting as a physical downstop, also prevents contacts 904 from touching each other and causing electrical shorting (even in the event of significant creep or plastic deformation of the contacts). Namely, the contacts are conductive and would short out if they touched one another.

Specifically, one or more of the walls of downstop structure 902 are formed, e.g., molded, to a height where they can act as a physical downstop to vertical movement of the electronic components which contact array 900 connects. For example, in an LGA, wherein contact array 900 is used to connect a chip module and a printed wiring board, a physical downstop can prevent these devices from excessively squeezing contacts 904 causing them to overly distort, contact each other and short.

According to this exemplary embodiment, the height of downstop structure 902 should be such that it does not prevent some desired initial, e.g., elastic, compression of contacts 904, and possibly even a limited amount of creep or plastic deformation of contacts 904. However, the height of downstop structure 902 should be great enough so as to prevent overcompression of the contacts, which could cause shorting. For example, if the height of downstop structure 902 is too short, contacts 904 may deform to such a degree that they contact each other prior to downstop structure 902 acting as a physical downstop.

Therefore, the height of downstop structure 902 needs to be optimized for a particular set of contact dimensions. For example, it is desirable to fabricate downstop structure 902 in such a way so as to isolate contacts 904 from one another, but at the same time minimize or eliminate contact of downstop structure 902 with contacts 904 before compression is carried out. Thus, each of contacts 904 is able to act independently of downstop structure 902. In one exemplary embodiment, the shape and/or the size of contacts 904 is configured such that contacts 904 do not come in physical contact with the walls of downstop structure 902 until some amount of compression has taken place. This helps ensure that there is sufficient room within downstop structure 902 for contacts 904 to expand and distort during compression.

Further, given that downstop structure 902 may comprise a selected CTE material, e.g., that is substantially similar to the CTE of the contacts, as described above, the configuration of exemplary contact array 900 may provide the added benefit of making the gap between a connected chip module and a printed wiring board change in response to temperature changes by about the same dimensions as the dimensions of the contacts would change due to the same temperature change. According to an exemplary embodiment, a difference between the CTE of the contacts and the CTE of the downstop structure is less than or equal to about 40 ppm, e.g., less than or equal to about 20 ppm.

Figure 9B:
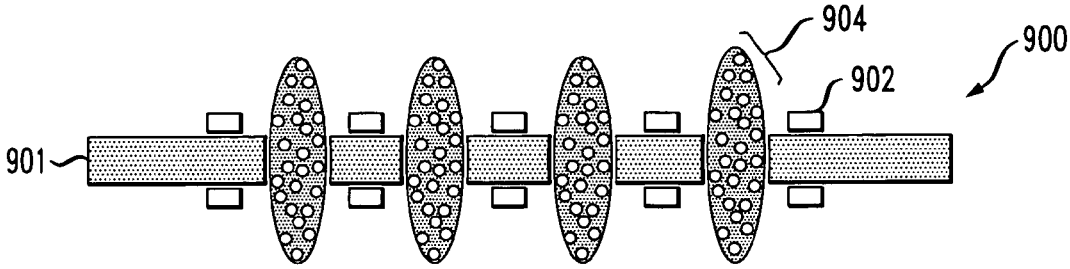
FIG. 9*b* is a diagram illustrating a side view of the exemplary contact array shown in FIG. 9*a* according to an embodiment of the present invention.

FIG. 9*b* is a diagram illustrating a side view of exemplary contact array 900 shown in FIG. 9*a*. As shown in FIG. 9*b*, the walls of downstop structure 902, prior to compression, are shorter (e.g., extend a lesser vertical distance from retaining member 901) than contacts 904. As mentioned above, the height of the walls of downstop structure 902 should be optimized for proper performance.

Figure 10A:
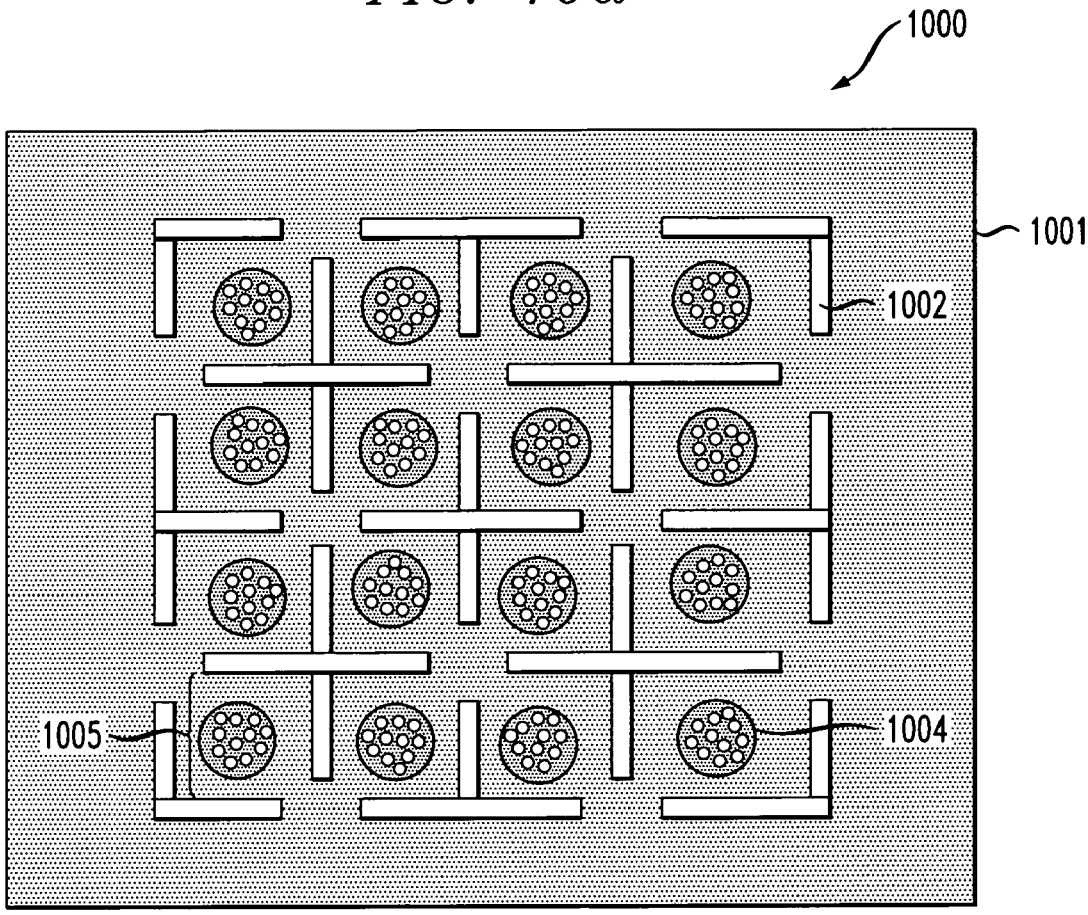
FIG. 10*a* is a diagram illustrating a top-down view of another exemplary contact array according to an embodiment of the present invention.

FIG. 10*a* is a diagram illustrating a top-down view of exemplary contact array 1000. Similar to exemplary contact array 900, described, for example, in conjunction with the description of FIG. 9*a* and FIG. 9*b*, above, exemplary contact array 1000 comprises downstop structure 1002 and contacts 1004 supported by retaining member 1001. However, unlike downstop structure 902, downstop structure 1002 is not continuous, and instead comprises short sections of linear walls traversing the closest points between contacts 1004, e.g., an open grid configuration. The open grid configuration comprises a number of compartments formed by the grid, e.g., compartments 1005.

Having an open grid configuration has several notable considerations. First, with the continuous grid configuration, e.g., downstop structure 902 described above, air may become entrapped in one or more of the compartments of the grid when 'sandwiched,' between the connected devices. During periods of increased temperature and pressure, such as during operation, the air can expand potentially leading to one or more temporary open circuits.

Therefore, according to one exemplary embodiment wherein an open grid configuration is employed, openings suitable for air passage are provided out of each compartment of the grid. For example, in downstop structure 1002, an opening is provided from each compartment out of the structure.

Also, the open grid configuration provides the benefit of utilizing less material to be formed and may potentially be easier to mold. It is notable that, with the open grid configuration, there is a chance that the contacts may interact with each other, e.g., through the openings, and short out, which would not occur with the continuous grid configuration.

Figure 10B:
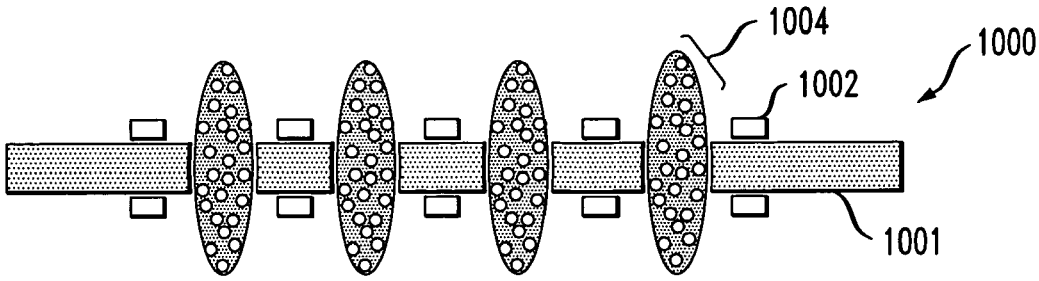
FIG. 10*b* is a diagram illustrating a side view of the exemplary contact array shown in FIG. 10*a* according to an embodiment of the present invention.

FIG. 10*b* is a diagram illustrating a side view of exemplary contact array 1000 shown in FIG. 10*a*. As described in conjunction with the description of FIG. 9*b*, above, the walls of downstop structure 1002, prior to compression, e.g., between a chip module and a printed wiring board, are shorter (e.g., extend a lesser vertical distance from retaining-member 1001) than contacts 1004.

Figure 11A:
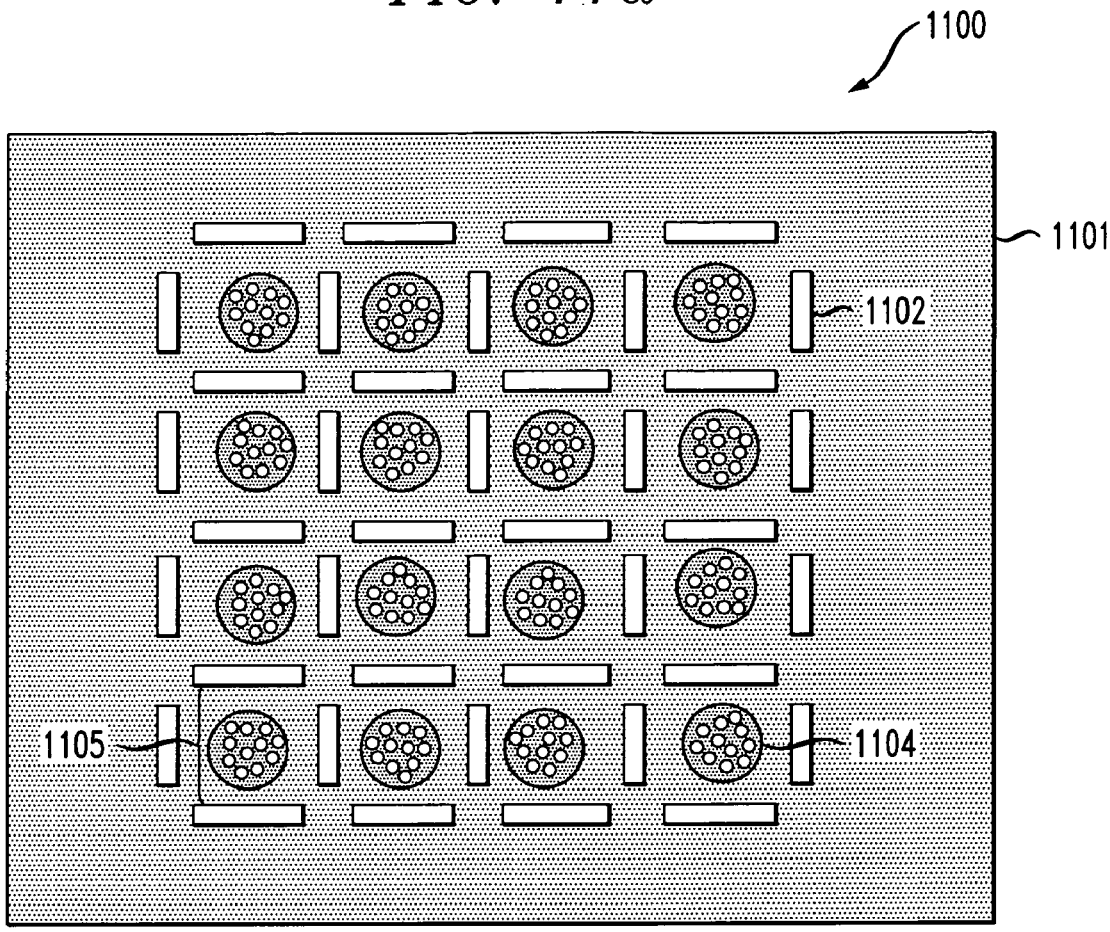
FIG. 11*a* is a diagram illustrating a top-down view of yet another exemplary contact array according to an embodiment of the present invention.

FIG. 11*a* is a diagram illustrating a top-down view of exemplary contact array 1100. Similar to exemplary contact array 1000, described, for example, in conjunction with the description of FIG. 10*a* and FIG. 10*b*, above, exemplary contact array 1100 comprises downstop structure 1102 and contacts 1104 supported by retaining member 1101. Like downstop structure 1002, downstop structure 1102 is non-continuous and comprises short sections of linear walls traversing the closest points between contacts 1104, e.g., an open grid configuration. The open grid configuration comprises a number of components formed by the grid, e.g., compartment 1105.

Figure 11B:
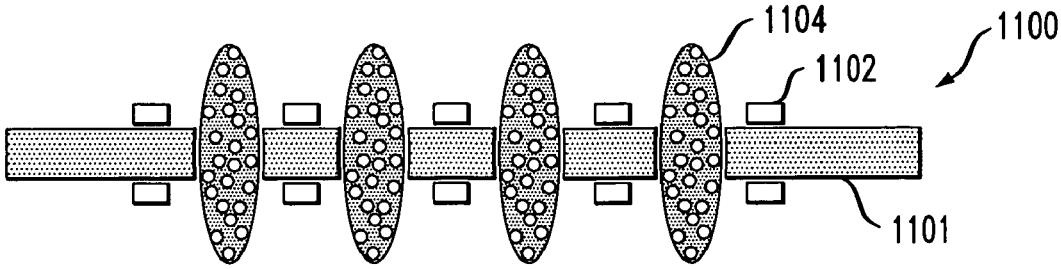
FIG. 11*b* is a diagram illustrating a side view of the exemplary contact array shown in FIG. 11*a* according to an embodiment of the present invention.

Downstop structure 1102 provides another suitable configuration for an open grid structure. As with downstop structure 1002, downstop structure 1102 comprises openings suitable for air passage out of each compartment of the grid out of the structure. FIG. 11*b* is a diagram illustrating a side view of exemplary contact array 1100 shown in FIG. 11*a*.

Figure 12A:
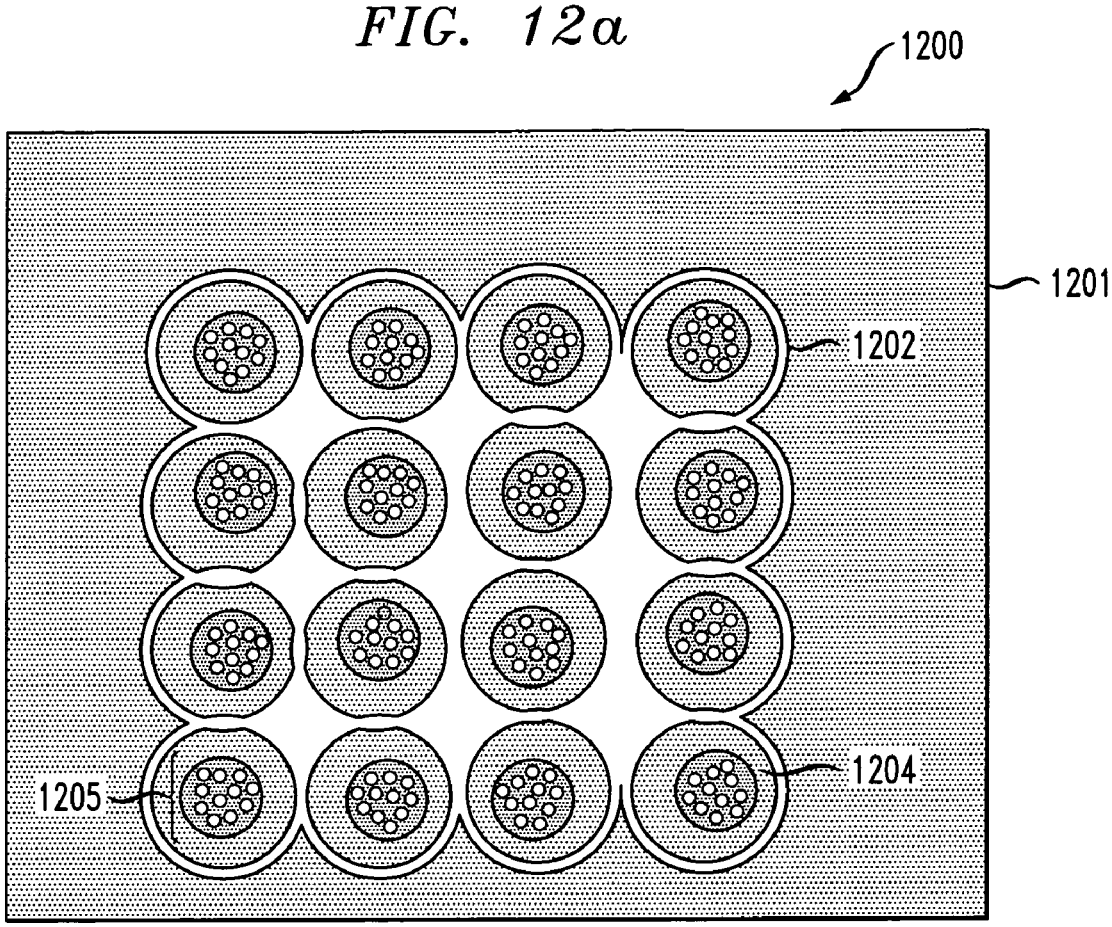
FIG. 12*a* is a diagram illustrating a top-down view of a further exemplary contact array according to an embodiment of the present invention.

FIG. 12*a* is a diagram illustrating a top-down view of exemplary contact array 1200. Similar to exemplary contact array configuration 900, described, for example, in conjunction with the description of FIG. 9*a* and FIG. 9*b*, above, exemplary contact array 1200 comprises downstop structure 1202 and contacts 1204 supported by retaining member 1201. Like downstop structure 902, downstop structure 1202 is continuous, however, downstop structure 1202 comprises curved walls between the closest points between contacts 1204. The configuration of downstop structure 1202 comprises a number of compartments formed by the curved walls, e.g., compartment 1205. A curved wall configuration is beneficial as it provides a uniform distance between downstop structure 1202 and contacts 1204.

Figure 12B:
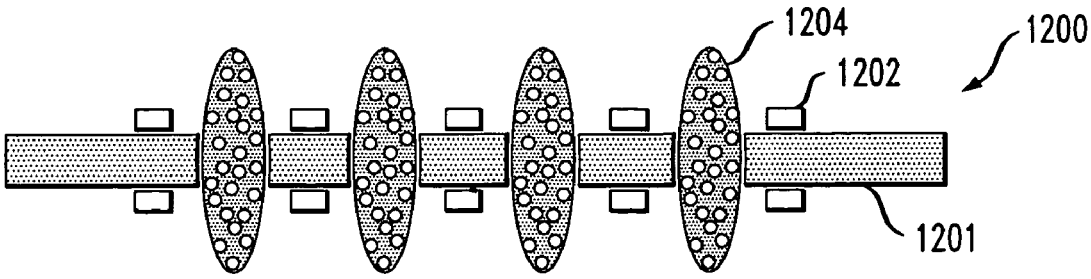
FIG. 12*b* is a diagram illustrating a side view of the exemplary contact array shown in FIG. 12*a* according to an embodiment of the present invention.

FIG. 12*b* is a diagram illustrating a side view of exemplary contact array 1200 shown in FIG. 12*a*. As described, for example, in conjunction with the description of FIG. 9*b*, above, the walls of downstop structure 1202 are shorter (e.g., extend a lesser distance from retaining member 1201) than contacts 1204.

Figure 13A:
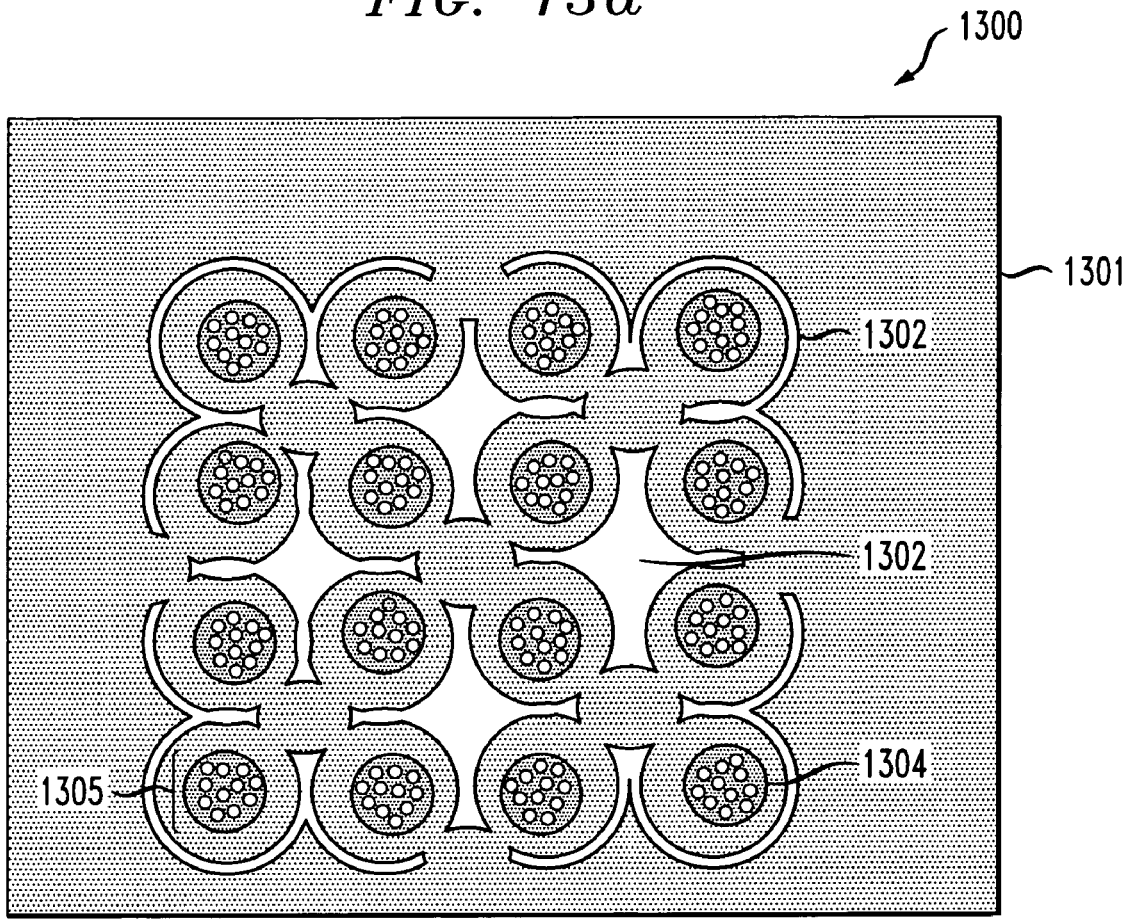
FIG. 13*a* is a diagram illustrating a top-down view of yet a further exemplary contact array according to an embodiment of the present invention.

FIG. 13*a* is a diagram illustrating a top-down view of exemplary contact array 1300. Similar to exemplary contact array 1200, described, for example, in conjunction with the description of FIG. 12*a* and FIG. 12*b*, above, exemplary contact array 1300 comprises downstop structure 1302 and contacts 1304 supported by retaining member 1301.

Unlike downstop structure 1202, downstop structure 1302 is not continuous, and instead comprises short sections of curved walls between the closest points between contacts 1304. Specifically, openings suitable for air passage are provided out of each circular compartment, e.g., for each of contacts 1304. The configuration of downstop structure 1302 comprises a number of compartments formed by the curved walls, e.g., compartment 1305.

Therefore, according to this exemplary configuration, air can escape the compartments and thus does not become trapped. Further, as mentioned above, a curved wall configuration provides a uniform distance to act as a physical stop between the contacted surfaces.

Figure 13B:
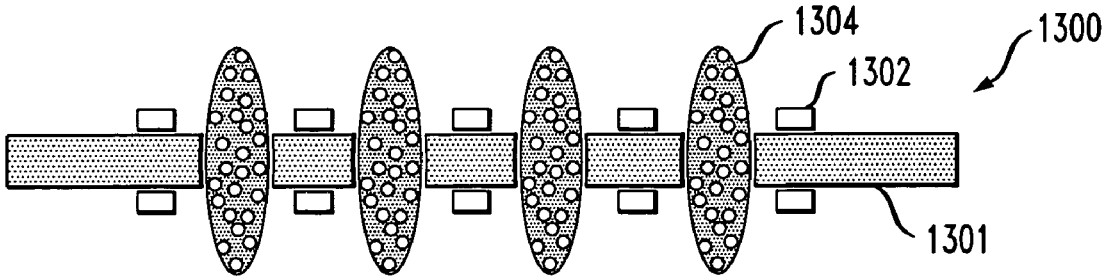
FIG. 13*b* is a diagram illustrating a side view of the exemplary contact array shown in FIG. 13*a* according to an embodiment of the present invention.

FIG. 13*b* is a diagram illustrating a side view of exemplary contact array 1300 shown in FIG. 13*a*.

In conclusion, techniques are provided herein that enhance interconnect array technology. For example, the exemplary array structures provided herein have different downstop configurations that improve interconnect function and reliability, e.g., by making the gap between a chip module and a printed wiring board change in response to a temperature change by about the same dimensions as contact dimensions would change due to the same temperature change.

Although illustrative embodiments of the present invention have been described herein, it is to be understood that the invention is not limited to those precise embodiments, and that various other changes and modifications may be made by one skilled in the art without departing from the scope or spirit of the invention.

What is claimed is:

1. An electrical connecting device comprising:

a plurality of compressible contacts; and a downstop structure surrounding at least a portion of one or more of the contacts, limiting compression of the contacts, and being configured to limit interaction between the contacts, whet cm said plurality of compressible contacts have a first coefficient of thermal expansion and said downstop structure has a second coefficient of Thermal expansion, the first coefficient of thermal expansion being substantially similar to the second coefficient of thermal expansion so that thermally induced dimensional changes of said downstop structure substantially match thermally induced dimensional changes of said plurality of compressible contacts.

2. The device of claim 1, wherein a difference between the first coefficient of thermal expansion and the second coefficient of thermal expansion is less than or equal to about 40 parts per million.

3. The device of claim 1, wherein a difference between the first coefficient of thermal expansion and The second coefficient of thermal expansion is less than or equal to about 20 parts per million.

4. The device of claim 1, wherein the downstop structure is configured to prevent physical contact between the contacts.

5. The device of claim 1, further comprising a retaining member, through which one or more of the contacts pass, configured to hold one or more of the contacts in position.

6. The device of claim 1, wherein one or more of the contacts comprise a metal particle filled polymer.

7. The device of claim 1, wherein one or mote of the contacts comprise a conductive silver particle filled siloxane material.

8. The device of claim 1, wherein the downstop structure is continuous around one or more of the contacts.

9. The device of claim 1, whet em the downstop structure is continuous around one or more of the contacts, the downstop structure comprising one or more linear portions.

10. The device of claim 1, wherein the downstop structure is continuous around one or more of the contacts, the downstop structure comprising one or more curved portions.

11. The device of claim 1, wherein the downstop structure is non-continuous around one or more of the contacts.

12. The device of claim 1, wherein the downstop structure is non-continuous around one or more of the contacts, the downstop structure comprising a plurality of openings.

13. The device of claim 12, wherein the openings are configured to allow for passage of air.

14. The device of claim 1, wherein the downstop structure is non-continuous around one or more of the contacts, the downstop structure being configured to have openings to allow for passage of air from compartments surrounding each of the contacts to out of the downstop structure.

15. The device of claim 1, wherein the downstop structure comprises one or more of polyethylene polymer, polyprophylene polymer, polyurethane polymer, rubber polymer, polyphosphazine and polysiloxane.

16. A method of fabricating an electrical connecting device, the method comprising the steps of:

forming a downstop structure surrounding at least a portion of one or more of a plurality of compressible contacts;

configuring the downstop structure to limit compression of the contacts; and configuring the downstop structure to limit interaction between the contacts, wherein said plurality of compressible contacts have a first coefficient of thermal expansion and said downstop structure has a second coefficient of thermal expansion, the first coefficient of thermal expansion being substantially similar to the second coefficient of thermal expansion so that thermally induced dimensional changes of said downstop structure substantially match thermally induced dimensional changes of said plurality of compressible contacts.

* * * * *